United States Patent [19]

Dyess et al.

[11] Patent Number: 4,795,182

[45] Date of Patent: Jan. 3, 1989

[54] WHEELCHAIR WITH PIVOTED BASKET

[76] Inventors: Larry B. Dyess; Kenneth R. Ball, both of P.O. Box 99, Geneva, Ala. 36340

[21] Appl. No.: 98,192

[22] Filed: Sep. 17, 1987

[51] Int. Cl.[4] ..... A61G 5/02

[52] U.S. Cl. ..... 280/289 WC; 70/227; 188/2 F; 188/69; 280/242 WC; 297/DIG. 4

[58] Field of Search ..... 280/289 WC, 242 WC; 297/DIG. 4, 148, 149, 150, 151, 152, 153, 154, 188, 194; 188/2 F, 30, 31, 69, 82.84, 82.9; 70/226, 227, 228

[56] References Cited

U.S. PATENT DOCUMENTS

| | | | |
|---|---|---|---|
| 925,810 | 6/1909 | Hopping | 70/226 |
| 1,198,025 | 9/1916 | Griesau | 70/226 |
| 3,369,839 | 2/1968 | Telarico . | |
| 3,580,631 | 5/1971 | Murcott . | |
| 3,912,032 | 10/1975 | Benz . | |
| 4,178,625 | 12/1979 | Schudel . | |
| 4,294,090 | 10/1981 | Metzger | 188/31 X |
| 4,403,786 | 9/1983 | Ulics | 280/289 WC |
| 4,436,339 | 3/1984 | Albers | 297/DIG. 4 X |
| 4,462,605 | 7/1984 | Morgan et al. | 297/DIG. 4 X |
| 4,484,755 | 11/1984 | Houston | 280/289 WC X |
| 4,526,419 | 7/1985 | Bowman . | |
| 4,566,732 | 1/1986 | Ostergaard, II et al. | 297/155 X |
| 4,580,803 | 4/1986 | Davis | 280/289 WC |
| 4,591,206 | 5/1986 | Pribble | 297/194 X |
| 4,705,287 | 11/1987 | Cumbie | 280/289 WC |

*Primary Examiner*—John J. Love
*Assistant Examiner*—Charles R. Watts
*Attorney, Agent, or Firm*—Fleit, Jacobson, Cohn & Price

[57] ABSTRACT

A wheelchair is provided including a forward transversely extending support mounted at one forward corner of the wheelchair for angular displacement about a horizontal axis for movement between a closed position extending between opposite side forward corner positions of the wheelchair and an open position projecting forwardly of the aforementioned one forward corner portion of the wheelchair, the other forward corner portion of the wheelchair and the support including coacting structure for releasably latching the support in the closed position and supporting the adjacent portion of the support against downward deflection relative to the wheelchair as a result of a load being supported by the support.

7 Claims, 2 Drawing Sheets

WHEELCHAIR WITH PIVOTED BASKET

BACKGROUND OF THE INVENTION

1. Field of the Invention

The present invention relates to a horizontal support mounted from the front of a wheelchair and extending thereacross and more specifically to a support which may be horizontally swung to one side of the wheelchair, the wheelchair being adapted to be used by disabled or ill persons in hospitals, nursing homes and supermarkets or in other areas where considerable walking by ill or disabled persons might be required.

2. Description of Related Art

Various different forms of wheelchair supports heretofore have been provided such as those disclosed in U.S. Pat. Nos. 3,369,839, 3,580,631, 3,912,032, 4,178,625, 4,403,786, 4,526,419, 4,566,732, 4,580,803 and 4,598,339. However, these previously known forms of wheelchair supports and the like do not include the overall combination of structural features incorporated in the instant inventin which particularly well adapte the wheelchair and support combination for use in carrying various loads by persons in a wheelchair. In addition, the wheelchair is equipped with a lockable (but overrideable) wheel brake designed to prevent unauthorized removal of wheelchairs from specified hospital, nursing home and supermarket areas.

SUMMARY OF THE INVENTION

The wheelchair of the instant invention incorporates a horizontally elongated and transversely extending support in the form of an upwardly opening basket and with the support mounted from forward opposite side frame portions of the wheelchair and extending therebetween and also for swinging movement of the support relative to one of the forward side frame portions of the wheelchair to an "open" position with the horizontally elongated support projecting forwardly of the one side frame portion of the wheelchair and thus "opening" the forward portion of the wheelchair in order that a person may arise from or assume a seated position in the wheelchair from forwardly thereof without interference from the support. Of course, the support is swingable back to and releasably latchable in a "closed" position extending across the front of the wheelchair after a person has assumed a seated position in the wheelchair.

The main object of this invention is to provide a wheelchair with a support mounted thereon whereby various articles may be supported from the wheelchair for a person seated therein and without the support or the articles supported thereby interfering with normal movement of the wheelchair.

Still another important object of this invention is to provide a support for a wheelchair and which will be capable of supporting various loads therefrom and yet will be swingable between a "closed" position extending across the front of the wheelchair and an "open" position projecting forwardly from one side of the wheelchair, all while a load of articles is supported from the support.

Still another object of this invention is to provide an article support for a wheelchair specifically adapted for use by disabled or ill persons in supermarkets, hospitals, nursing homes and other areas which would otherwise require considerable walking or standing.

An ancillary object of this invention is to provide a wheelchair article support in accordance with the preceding objects and constructed in a manner such that the support may be readily swung between the "closed" and "open" positions thereof and further latched in the "closed" position by a large percentage of persons who may benefit from the use of the wheelchair.

Yet another object of this invention is to provide an article support and mounting structure therefor constructed in a manner whereby the article support may be readily disengaged from the associated wheelchair.

A further object of this invention is to provide a wheelchair in accordance with the preceding objects and equipped with a key lockable wheel brake for preventing casual unauthorized usage of the wheelchair and yet with the brake being constructed in a manner such that important or emergency use thereof may be readily had without utilizing a key to unlock the wheel brake.

A final object of this invention to be specifically enumerated herein is to provide a wheelchair equipped with an article carrier and a key lockable wheel brake in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
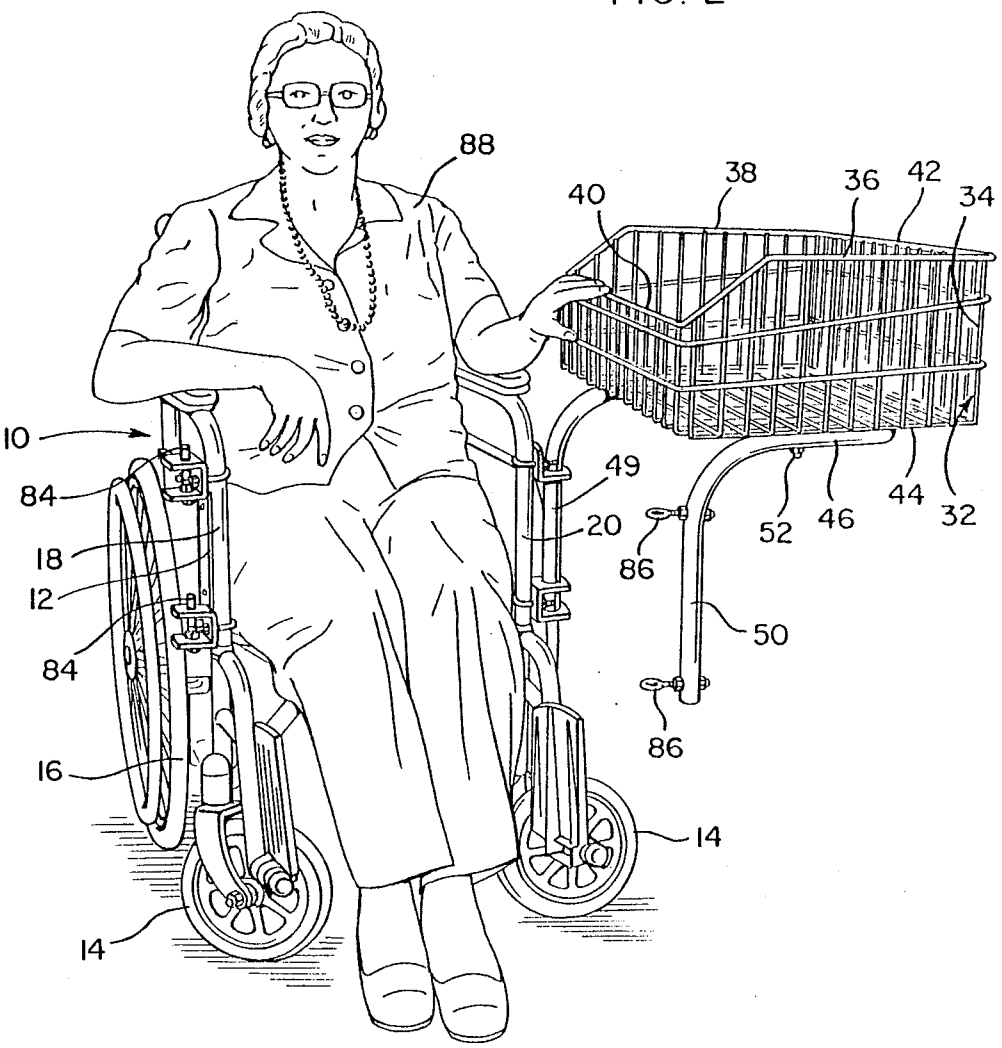
FIG. 2 is a front perspective view similar to FIG. 1 but with the basket-type article support of the instant invention in the "open" position thereof.

Referring now more specifically to the drawings, the numeral 10 generally designates a conventional form of wheelchair including a main frame 12 from which a pair of opposite side dirigible front wheels 14 are journalled as well as a pair of opposite side rear fixed axle wheels 16. The frame 12 includes right and left forward vertical frame portions 18 and 20 as well as a right rear frame portion 22. In addition, the right rear wheel 16 is journalled from an axle shaft 24 secured through the lower end of the vertical frame portion 22 and includes a cylindrical hub 26 from which the radial innermost ends of a plurality of spokes 28 are mounted, the radial outermost ends of the spokes 28 supporting a rim 30 upon which a tire 32 is mounted and the spokes 28 being arranged in sets of crossed inner and outer sets of spokes which are radially outwardly convergent toward the rim 30.

The support of the instant invention is referred to in general by the reference numeral 32 and incorporates a horizontally elongated wire mesh basket 34 including opposite end walls 36 and 38, a rear wall 40 and a front wall 42 interconnected by a horizontal bottom wall 44. In addition, the support 32 incorporates a rearwardly opening U-shaped frame underlying the bottom wall 44 and including front-to-rear extending parallel legs 46 interconnected at their forward ends by an integral bight portion 48, the rear ends of the legs 46 terminating rearwardly in first and second depending tubular support members 49 and 50 and the bottom wall 40 being anchored relative to the legs 46 through the utilization of removable fasteners 52.

Figure 1:
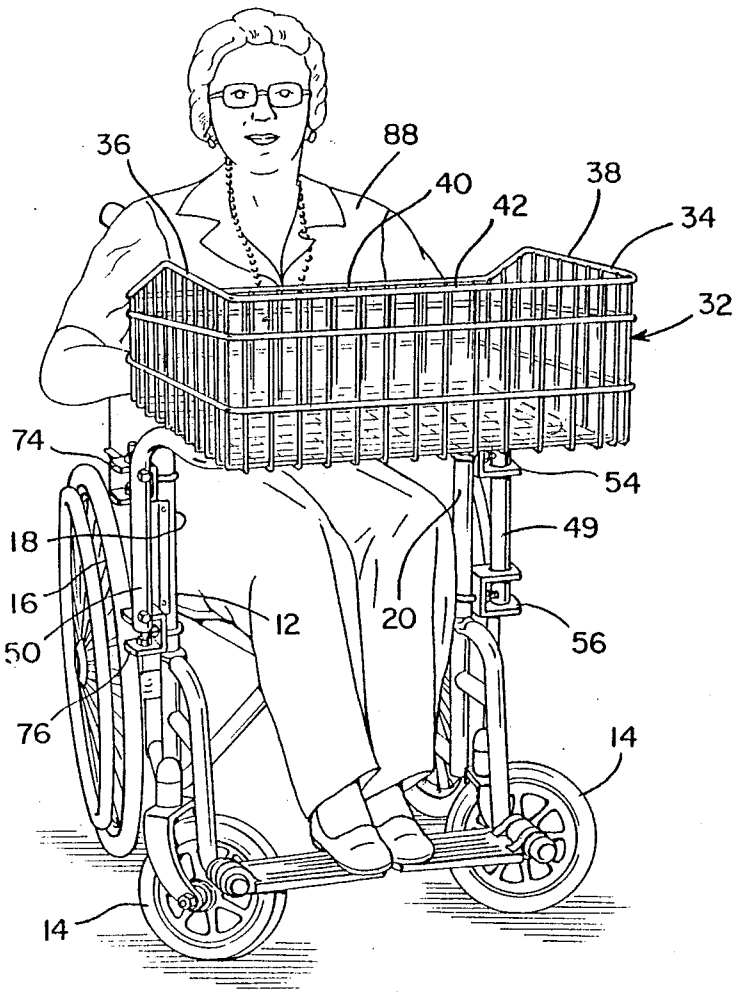
FIG. 1 is a front perspective view of a conventional form of wheelchair with the basket-type article support of the instant invention operatively associated therewith and illustrated in the "closed" position thereof.

A pair of vertically spaced mounting brackets 54 and 56 are supported from the frame portion 20 through the utilization of U-bolts 58 and 60. The bracket 54 includes a horizontal flange 62 having a circular opening 65 formed therethrough and the bracket 56 includes upper and lower flanges 66 and 68 with the flange 66 having a circular opening 70 formed therethrough registered with the opening 64. The support member 48 extends down through the openings 64 and 70 and abuts the upper surface of the flange 68 and is therefore rotatably supported from the brackets 54 and 56 for oscillation of the support 32 relative to the wheelchair 10 about an axis coinciding with the longitudinal center line of the support member 49 for swinging between a closed position, such as that illustrated in FIG. 1, and an open position, such as that illustrated in FIG. 2.

Figure 3:
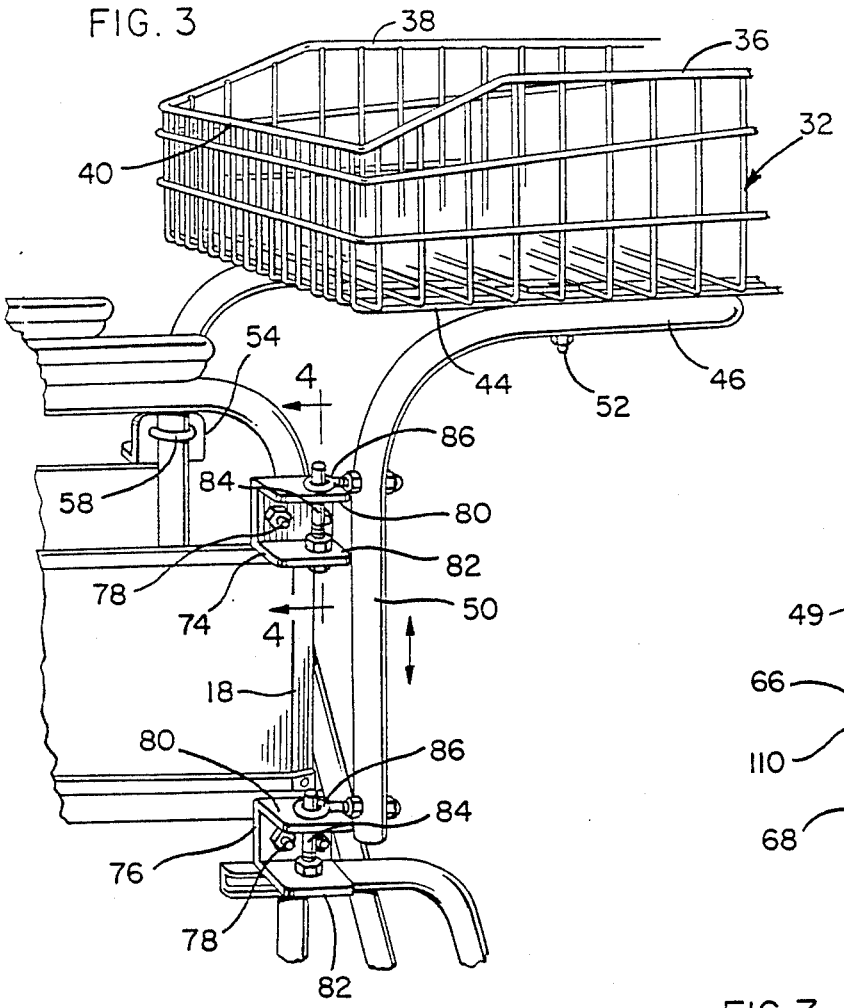
FIG. 3 is an enlarged fragmentary right side perspective view of the forward portion of the wheelchair and the basket-type article support illustrating the manner in which the article support may be latched in the "closed" position.
Figure 4:
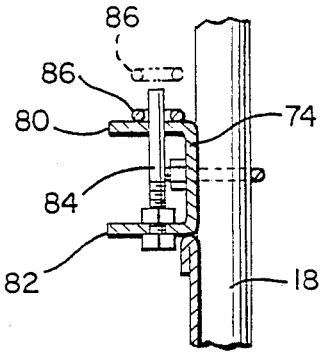
FIG. 4 is an enlarged fragmentary vertical sectional view taken substantially upon the plane indicated by the section line 4—4 of FIG. 3.
Figure 6:
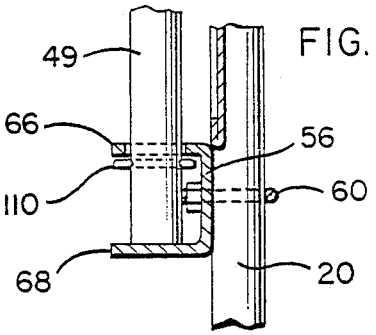
FIG. 6 is an enlarged fragmentary vertical sectional view taken substantially upon the plane indicated by the section 6—6 of FIG. 5.
Figure 5:
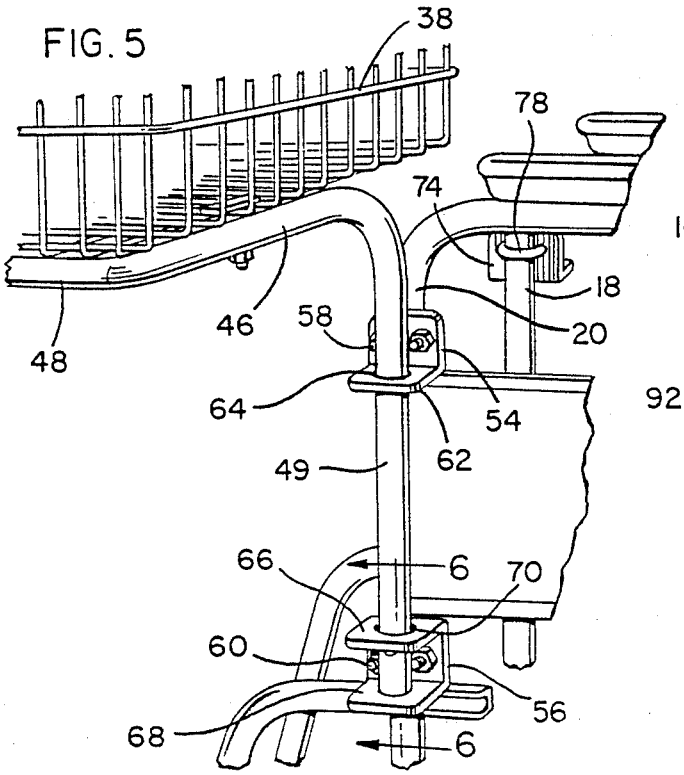
FIG. 5 is an enlarged fragmentary left side perspective view of the forward portion of the wheelchair with the basket-type support in the "open" position.
Figure 7:
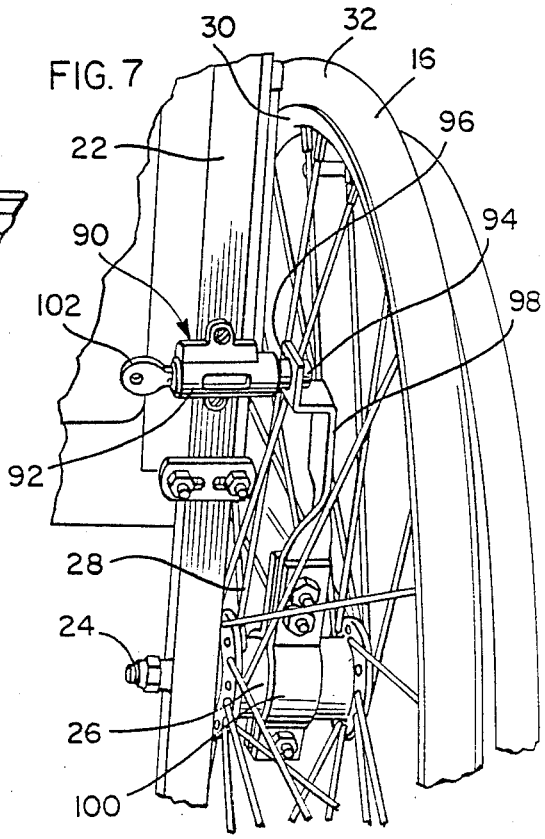
FIG. 7 is a fragmentary rear perspective view of the rear portion of the right side of the wheelchair illustrating the key operated wheel lock for the right rear wheel of the wheelchair.

With attention now invited more specifically to FIG. 3, the frame portion 18 includes upper and lower brackets 74 and 76 supported therefrom through the utilization of U-bolts 78 and the brackets 74 and 76 each include upper and lower horizontal flanges 80 and 82 between which a latch pin 84 is supported, the upper ends of the latch pins 84 projecting above the corresponding flanges 80. In addition, the support member 50 includes a pair of anchor eyes 86 supported therefrom and when the support 32 is swung toward the "closed" position illustrated in FIG. 1, the anchor eyes 86 abut the upper ends of the pins 84 and the person 88 seated in the wheelchair 10 may exert an upward force on the support member 50 or the adjacent end of the corresponding leg 46 to lift the eyes 86 to positions spaced above the upper ends of the pins 84 as illustrated in phantom lines in FIG. 4, after which the upper force on the support member 50 may be released in order that the eyes 56 may pass downwardly over the upper ends of the pins 84 and rest upon the upper flanges 80. In this manner, the support 32 may be latched in the "closed" position.

The support 32 is constructed in a manner such that it may support at least 40 lbs. of articles within the basket 34 without causing upset of the wheelchair 10 when the latter is unoccupied and the support 32 is in the open position thereof illustrated in FIG. 2, but weights (not shown) may be added to the right hand side of the wheelchair 10 in order to offset the cantilever support of still further weight from the support 32, if desired.

It is envisioned that the combination of the wheelchair 10 and support 32 will find considerable use in hospitals, supermarkets, nursing homes and in other environments in which movement of persons in wheelchairs over appreciable distances is expected. In hospitals, wheelchairs 10 equipped with the supports 32 may be used by persons entering a hospital, requiring the use of a wheelchair and having at least some luggage with them. Further, the same wheelchairs may be used when persons are discharged from the hospital and are carrying luggage and/or flowers from the hospital.

Also, the wheelchair and support combination may be used to advantage in supermarkets and in nursing homes as well as other similar environments.

However, in substantially all instances of intended usage of the wheelchair and support combination of the instant invention, it is proposed that the wheelchair 10 and attendant support 32 will have a predetermined location when not in use in order that all instances of intended usage thereof may be accorded. For this purpose, the wheelchair 10 is equipped with a lockable wheel brake assembly referred to in general by the reference numeral 90 and incorporating a key operated lock 92 with an extendable latch 94 projectable through an opening 96 in a wheel mounted keeper arm 98.

The keeper arm 98 includes a base end which is clamp mounted from the hub 26 as at 100 against angular displacement about the hub 26 and the free end of the keeper arm 98 projects outward between adjacent spokes of the inner set of spokes 28 and is registrable with the lock 92 for reception of the latch 94 through the opening 96. Accordingly, the key 102 of the lock 92 may be operated to project the latch 94 through the opening 96 or to retract the latch 94 through the opening 96. The key 102 is of course removable and may be in the possession of a person authorized to use the chair or to issue the chair for use by another person. When use of the chair 10 is authorized, the lock 92 is actuated to withdraw the latch 94 through the opening 96, thereby unlocking the wheel 16 for rotation. However, when the latch 94 projects through the opening 96, the wheel 16 is locked against rotation and unauthorized use of the chair 10 is discouraged.

On the other hand, the keeper arm 98 is bendable as a result of reasonable manual force applied thereto and any person desiring emergency use of the chair 10 but not having access to the key 102 may merely grasp the radial outermost end of the keeper arm 98 and bend it slightly toward the outer side of the wheel 16, thus releasing the keeper arm 98 from the latch 94, the extended position of the latch 94 not interfering with movement of the inner set of spokes 28 passed the latch 94.

The lower end portion of the support member 49, between the flanges 66 and 68 of the bracket 56, includes a removable latch pin 110 secured therethrough in order to prevent upward movement of the support member 49 relative to the bracket 56 when an upward force is applied to the support member 50 in order to elevate the eyes 86 above the upper ends of the pins 84. Thus, the support 32 is locked in engagement with the chair 10. However, the pin 110 may be removed in order that the entire support 32 may be removed from the wheelchair 10, leaving only the brackets 54, 56, 74 and 76 mounted upon the wheelchair 10. The lock assembly 90 may be rendered inoperative at any time through the utilization of the key 102. However, the lock assembly 90 is deemed to be important to the chair 10 and support 32 to insure that unwanted movement of the chair 10 from its predetermined non-use position is prevented.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. In combination with a wheelchair having a frame supported on a plurality of wheels and incorporating a central seat portion and a pair of opposite side forward frame portions adjacent a forward portion of said seat portion and between which the legs of a person seated on said seat portion extend, a horizontally elongated transverse support extending transversely of said wheelchair and including first and second ends equipped with first and second support means, respectively, said first support means and one of said forward frame portions including first coacting means supporting said first end from said one forward frame portion for oscillation relative to the latter about an upstanding axis and swinging of said support between a first "closed" position extending transversely of said wheelchair and between said forward frame portions and a second "open" position with said second end of said support swung forwardly from the other forward frame portion to a position extending forwardly from said one forward frame portion, said second support means and said other forward frame portion including second coacting support means operative to releasably latch said second end relative to said other forward frame portion with said support in said first position, said first support means including a depending support member carried by said first end of said transverse support and comprising a part of said first coacting means, said first coacting means also including a pair of vertically spaced bracket portions supported from said one forward frame portion and defining vertically registered and aligned openings formed therethrough, said support member being snuggly slidably and rotatably received through said openings, said depending support member and one of said bracket portions including coacting abutment means limiting downward sliding movement of said support member through said openings while allowing unrestricted upward sliding withdrawal of said depending support member through said openings, said second support means including a second support member depending from said second end of said transverse support and comprising a part of said second coacting means, said second coacting means also including a pair of upper and lower vertically spaced bracket portions supported from said other forward frame portion, said second support member including upper and lower portions horizontally registered with said upper and lower bracket portions of said other forward frame portion when said support is in said "closed position", at least said lower bracket portion supported from said other forward frame portion and said lower portion of said second support member including abuttingly engaged portions preventing further swinging of said lower portion of said second support member past said "closed position", said upper portion of said second support member and said upper bracket portion supported from said other forward frame portion including releasably relatively hook engaged portions thereof preventing downward movement of said upper portion of said second support member relative to said upper bracket portion supported from said other forward frame portion and swinging movement of said upper portion of said second support member relative to said upper bracket portion of said other forward frame portion from said "closed position" toward said "open position".

2. The wheelchair and horizontal support of claim 1 wherein said support comprises an upwardly opening receptacle.

3. The wheelchair and horizontal support of claim 1 wherein one of said wheels and said frame include coacting means releasably locking said one wheel against rotation relative to said frame.

4. The wheelchair and horizontal support of claim 1 wherein said horizontal support comprises an upwardly opening receptacle and includes an underlying rearwardly opening generally U-shaped frame upon which said receptacle is mounted, said frame including a pair of generally parallel front-to-rear extending legs interconnected at their front ends by a transverse bight portion, said first an second support means comprising first and second portions depending downwardly from said first and second ends of said support, said depending portions depending downwardly from the rear ends of said legs.

5. The wheelchair and horizontal support of claim 1 wherein one of said wheels and said frame include coacting means releasably locking said one wheel against rotation relative to said frame.

6. In combination with a wheelchair having a frame supported on a plurality of wheels and incorporating a central seat portion and a pair of opposite side forward frame portions adjacent a forward portion of said seat portion and between which the legs of a person seated on said seat portion extend, a horizontally elongated transverse support extending transversely of said wheelchair and including first and second ends equipped with first and second support means, respectively, said first support means and one of said forward frame portions including first coacting means supporting said first end from said one forward frame portion for oscillation relative to the latter about an upstanding axis and swinging of said support between a first "closed" position extending transversely of said wheelchair and between said forward frame portions and a second "open" position with said second end of said support swung forwardly from the other forward frame portion to a position extending forwardly from said one forward frame portion, said second support means and said other forward frame portion including second coacting support means operative to releasably latch said second end relative to said other forward frame portion with said support in said first position, said first and second support means comprising first and second portions depending downwardly from said first and second ends of said support, said first coacting means including a pair of vertically spaced bracket portions supported from said forward frame portion from which said first depending portion is oscillatably supported, said second coacting means including vertically extending aperture defining and lock pin defining means carried by said second end and said other forward frame portion registered with each other when said support is in said first position with said pin defining means extending through the aperture defined by said aperture defining means, said second end of said support being slightly upwardly displaceable relative to said other forward frame portion to withdraw said lock pin defining means from said aperture to free said second en of said support for swinging from said first position toward said second position.

7. In combination with a wheelchair having a frame supported on a plurality of wheels and incorporating a central seat portion and a pair of opposite side forward frame portions adjacent a forward portion of said seat portion and between which the legs of a person seated on said seat portion extend, a horizontally elongated transverse support extending transversely of said wheelchair and including first and second ends equipped with first and second support means, respectively, said first support means and one of said forward frame portions including first coacting means supporting said first end from said one forward frame portion for oscillation relative to the latter about an upstanding axis and swinging of said support between a first "closed" position extending transversely of said wheelchair and between said forward frame portions and a second "open" position with said second end of said supports swung forwardly from the other forward frame portion to a position extending forwardly from said one forward frame portion, said second support means and said other forward frame portion including second coacting support means operative to releasably latch said second end relative to said other forward frame portion with said support in said first position, one of said wheels and said frame including coacting means releasably locking said one wheel against rotation relative to said frame, said one wheel including a central cylindrical hub portion and sets of opposite end generally radially outwardly extending spokes mounted from said hub portion, the outer ends of said sets of spokes being convergent and supporting a rim and tire therefrom, said coacting means releasably locking said one wheel against rotation relative to said frame including an elongated keeper arm having one end anchored relative to said hub for rotation therewith and extending generally radially outwardly therefrom, the other end of said keeper arm including a terminal end portion projecting slightly outwardly between adjacent spokes of said wheel and having an aperture formed therethrough generally paralleling the axis of rotation of said one wheel, and key operated lock means mounted from said frame and including a latch pin with which said aperture is registered in one position of rotation of said one wheel and projectable through said aperture.

* * * * *